US008281729B1

(12) United States Patent
Beck

(10) Patent No.: US 8,281,729 B1
(45) Date of Patent: Oct. 9, 2012

(54) LIVEWELL DRAINAGE SYSTEM WITH INTEGRATED RETRACTABLE HOSE ASSEMBLY

(76) Inventor: Mickey Beck, Lebanon, TN (US)

( * ) Notice: Subject to any disclaimer, the term of this patent is extended or adjusted under 35 U.S.C. 154(b) by 137 days.

(21) Appl. No.: 12/840,727

(22) Filed: Jul. 21, 2010

(51) Int. Cl.
*B63B 35/14* (2006.01)

(52) U.S. Cl. ..... 114/255; 43/57

(58) Field of Classification Search ..... 114/255; 251/294, 304; 43/55, 57, 56
See application file for complete search history.

(56) References Cited

U.S. PATENT DOCUMENTS 4,033,280 A * 7/1977 Wood et al. ..... 114/255
4,708,084 A 11/1987 Campau
4,970,982 A 11/1990 Martin
5,010,836 A 4/1991 Riviezzo
5,236,175 A 8/1993 Campau
5,632,220 A * 5/1997 Vento ..... 114/255
2006/0070679 A1 4/2006 Ragner
2006/0112609 A1 6/2006 Lee

* cited by examiner

*Primary Examiner* — Lars A Olson
(74) *Attorney, Agent, or Firm* — Waddey & Patterson, P.C.; Gary L. Montle

(57) ABSTRACT

A drainage system is provided for a livewell compartment within a fishing boat. A flexible and reinforced hose is coupled on a first end to a pump assembly associated with the livewell and extends through an aperture in the boat hull to a second end. A seal interfaces the hose and the hull in association with the aperture. Fluid is delivered from the livewell through the hose to the exterior of the boat through the second end of the hose. The hose includes a compression or tension spring which applies a first longitudinal force with respect to the second end of the hose. The hose is effective to extract from the hull in response to a second longitudinal force applied to the hose and greater than the first force, and is retractable toward the hull in the absence of the second force.

16 Claims, 3 Drawing Sheets

LIVEWELL DRAINAGE SYSTEM WITH INTEGRATED RETRACTABLE HOSE ASSEMBLY

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: None

BACKGROUND OF THE INVENTION

The present invention relates generally to fishing boats with livewell tanks. More particularly, the present invention relates to a system and method for draining livewell tanks. The present invention is particularly relevant for tournament fishing applications where for example the contents of livewell tanks are desirably drained into a bag rather than onto the ground.

In fishing applications it is generally desirable to keep the fish that have been caught alive for the duration of the time that an individual wishes to remain fishing. For the fisherman who intends to eat his or her catch, the longer the fish remains alive the better the fish is likely to taste. For the sport fisherman, keeping the fish alive is even more important, as it is generally a requirement to collect any prizes or awards in a tournament situation that the fish are alive when weighed at the end of the tournament and subsequently releasable.

When fishing from a boat in a tournament situation it is important to have a degree of mobility and therefore it is desirable to provide a tank within the interior of the boat, or "livewell" which is suitable for storing the fish alive for the duration of the time spent fishing. A livewell as is typically known in the art includes an intake system to pump water into the tank from the adjacent body of water and an overflow drain which discharges water from the tank as it flows over a threshold level. A drainage system is further effective to empty the livewell of all water contained therein when the livewell is no longer required.

The livewell may further include systems for aerating the water during movement by the fishing boat, such that a sufficient amount of oxygen remains in the water to keep the fish alive. Chemicals are frequently added such as pH treatments or tranquilizers which medicate the fluid in the livewell and further preserve the ability of the fish to survive the livewell environment for an extended period of time.

In various livewell drainage systems as presently known in the art, the drainage system discharges water from the livewell through a hose coupled to a pump including at least a two-way valve to direct the water flow out of an aperture in the hull and above the waterline of the boat. In this way the livewell may be drained of water regardless of whether the boat is itself currently in or out of the water.

However, for a tournament fisherman in particular it is generally desirable to preserve some of the water from the livewell rather than draining it entirely onto the ground or into the body of outside water. This is because the tournament fisherman needs to transport the fish that have been caught to a remote area for weighing, and therefore needs the water from the livewell to be maintained in a portable device such as a bag or basket within which the fish may be safely carried to and from the weighing area without dying. As the portable device typically will not include means for sufficiently aerating the water, it is even further desirable that the livewell water be used rather than untreated water, as the medicated or otherwise treated water will preserve the fish for a longer period of time.

A tournament fisherman must therefore discharge livewell water through the aperture in the side of the boat and into a bag or equivalent portable device. This presently requires the fisherman to lean over the side of the boat and hold the bag proximate the drainage area, or if the boat is pulled out of the water the fisherman can alternatively catch the livewell water in the bag from outside of the boat. These options are both serviceable but not particularly desirable, as the first option is somewhat awkward and can even be painful, particularly where repeated a sufficient number of times. Further, while the second option is less strenuous where available, it frequently results in the fisherman being soaked with the stream of water that is discharged from the boat.

BRIEF SUMMARY OF THE INVENTION

A system is disclosed herein for convenient discharge of fluid from a livewell on a fishing boat. The livewell discharge system of the present invention is convertible in installation and easily attaches to an existing livewell system in a conventional fishing boat. Instead of a standard hose extending from the livewell pump system to a termination point at the boat hull, a flexible reinforced hose assembly is provided which extends from the livewell pump system through a seal and to the exterior of the boat. The hose assembly is extendable and retractable between a first position and a second position for convenience of use. The user can simply grasp an end of an extendable hose which terminates at the exterior of the boat and pull the end of the hose to a position proximate a portable device such as for example a bag. A pumping system then discharges the fluid from the livewell through the extendable hose and into the bag in a more focused and reliable stream.

In this manner the user can easily fill the portable device with the fluid, without the awkward positioning required when the operation is performed from within the boat, and further without the spillage and accompanying wet clothing that results from performing the operation outside of the boat.

After the portable device has been sufficiently filled with fluid, the user may release the hose, which is further retractable and returns to a retracted position proximate the aperture in the boat hull until the next time it is required by the user.

The livewell drainage system of the present invention, in addition to making collection of the fluid from the livewell easier on the user, provides a healthier alternative as the user is not required to use whatever water is most presently available, and which may be potentially contaminated and therefore harmful to the fish.

Another benefit of the present invention is that it allows the existing medicated/cool and/or salt water or other liquid that is already in the livewell to be reused by the fisherman. By reusing the fluid in the livewell, the costs of the fuid treatment may be relatively reduced and the life and welfare of the fish stored therein may be even further preserved.

Briefly stated, in an embodiment of the present invention a livewell drainage system includes a livewell tank residing within a boat and a retractable hose assembly coupled on a first end to the livewell and extending from the livewell through an aperture in the boat to a second end outside the boat. The second end of the hose assembly further includes an end cap having a diameter greater than an outer diameter of the boat aperture. The second end of the hose assembly during normal operation is urged to a first position against the boat and adjacent the aperture. The second end of the hose assembly during a drainage operation is moveable from the first position to a second position away from the boat in response to a longitudinal force applied by a user with respect to the hose.

In another embodiment of the present invention, a livewell drainage system is provided for a fishing boat having an interior, a hull and a livewell tank residing within the interior. A retractable hose assembly has a first section within the interior of the fishing boat and coupled to the livewell tank, and a second section extending outside of the interior of the fishing boat through an aperture in the boat hull. The hose assembly further includes an outer layer of a braided material and at least a portion of the hose assembly is reinforced by an inner layer with a spring. The spring urges the second end of the hose assembly against an exterior side of the boat adjacent the aperture, and the second end of the hose assembly is extendable from the exterior side of the boat in response to a longitudinal force with respect to the hose assembly.

In another embodiment of the present invention, a drainage system is provided for a livewell compartment within a fishing boat. A mechanical pump assembly coupled to the livewell, and a hose is coupled on a first end to the pump assembly and extends through an aperture in the boat hull to a second end. A seal interfaces the hose and the hull in association with the aperture. The pump delivers fluid from the livewell to the exterior of the boat through the second end of the hose. The hose includes a spring arranged along at least a portion of its length and which applies a first longitudinal force with respect to the second end of the hose. The hose is effective to extract from the hull in response to a second longitudinal force applied to the hose and greater than the first force.

DETAILED DESCRIPTION OF THE INVENTION

Figure 1:
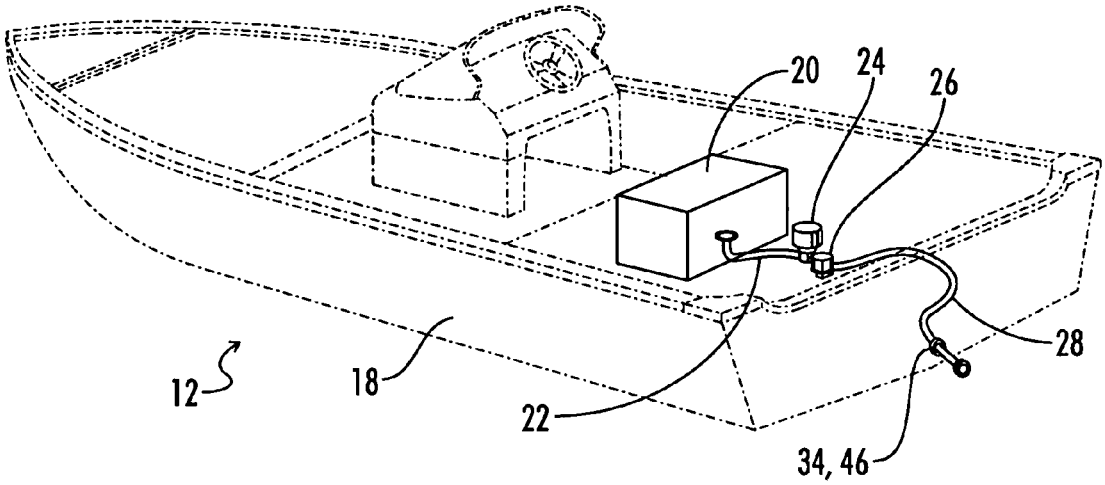
FIG. 1 is an isometric view showing a fishing boat and livewell as conventionally known in the art, with an embodiment of a livewell drainage system of the present invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct physical connection between the connected items or an indirect connection through one or more passive or active intermediary devices.

Referring generally to FIGS. 1-6, various embodiments of a livewell discharge system in accordance with the present invention may be further described herein. Where the various figures may describe embodiments sharing various common elements and features with other embodiments, similar elements and features are given the same reference numerals and redundant description thereof may be omitted below.

Figure 2:
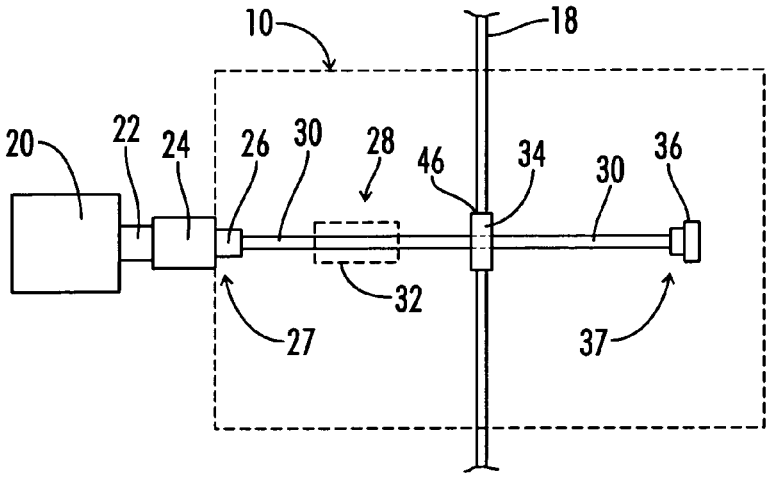
FIG. 2 is a block diagram of an embodiment of the livewell drainage system as disclosed herein.

Referring now to FIGS. 1-2, in an embodiment of the present invention a livewell drainage system 10 is coupled to a livewell 20 and a livewell discharge pump assembly 24.

In the configuration as shown the pump is located remotely from the livewell itself and coupled to the livewell by a conduit 22 such as a pipe or hose. Alternatively, various configurations are known to those of skill in the art in which the pump 24 may be coupled directly to the livewell or may even be positioned inside of the livewell. The configuration shown further includes only a discharge pump assembly, but alternative configurations are also known in the art where the pump assembly may include a pump and a three way valve which permits both intake and discharge systems to be coupled to the same pump and directs the water flow into and out of the livewell accordingly. The specific positioning and configuration of the pump assembly 24 is not however of consequence for the present invention, and further description will be omitted as unnecessary.

Referring more particularly to FIG. 2, in an embodiment the system 10 includes a retractable hose assembly 28, a converter 26 at a first end 27 of the hose assembly 28 for coupling the hose assembly 28 to the pump assembly 24, a seal 34 disposed at an aperture 46 in the boat hull 18 and which the hose assembly 28 is shaped to engage and slide through, and a cap 36 at a second end 37 of the hose assembly 28. The hose assembly 28 is extendable in a first direction such that the cap 36 may be pulled by a user away from the hull 18 of the boat, and is further inherently biased in a second direction opposite from the first direction such that in the absence of a pulling force provided by the user the cap 36 is retracted against the boat hull 18 proximate the aperture 46.

In various embodiments the hose assembly 28 includes a hose 30 having at least an outer layer of a braided material and a reinforced inner layer. In the examples shown in FIGS. 3-4, the hose 30 has an outer diameter of about ⅝" and an inner diameter of about ⅜", but these dimensions are, if not arbitrary, not intended otherwise to be limiting on the scope of the present invention. The hose assembly 28 further includes a spring assembly 32 which applies the biasing force to the hose 30 as described above.

Figure 3:
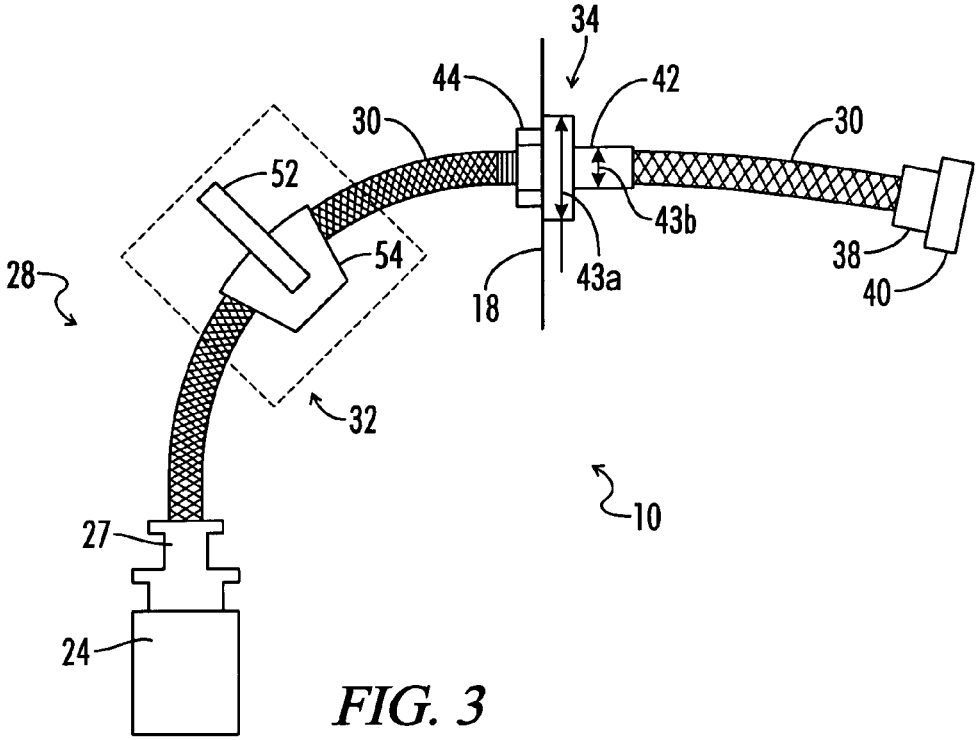
FIG. 3 is an illustrative view showing an embodiment of the system including a tension spring system.

Referring more particularly to FIG. 3, in an embodiment the spring assembly 32 includes an extension spring 52 placed in tension to provide a biasing longitudinal force upon the hose assembly 28, and an additional reinforcing layer 54. The spring assembly 32 is positioned in a first section of the hose assembly 28 which resides within the interior of the boat hull regardless of how far the hose assembly 28 is extended or otherwise withdrawn from the seal 34 and away from the boat hull outside of the boat. In other words, the tension of the spring assembly 32 is arranged within a first section of the hose assembly 28 which applies the biasing force with respect to a second section of the hose assembly 28 which may extend outside of the boat through the aperture 46 and seal 34.

For descriptive purposes, the term "longitudinal force" may describe a force with respect to the length of the hose 30 in the hose assembly 28, or more generally describe a force which when applied to the hose assembly 28 tends to pull the second end 37 of the hose assembly 28 toward (e.g., a first longitudinal force such as would be applied by the biasing spring assembly) or away from the boat hull (e.g., a second longitudinal force such as would be applied by a user from outside of the boat).

Figure 4:
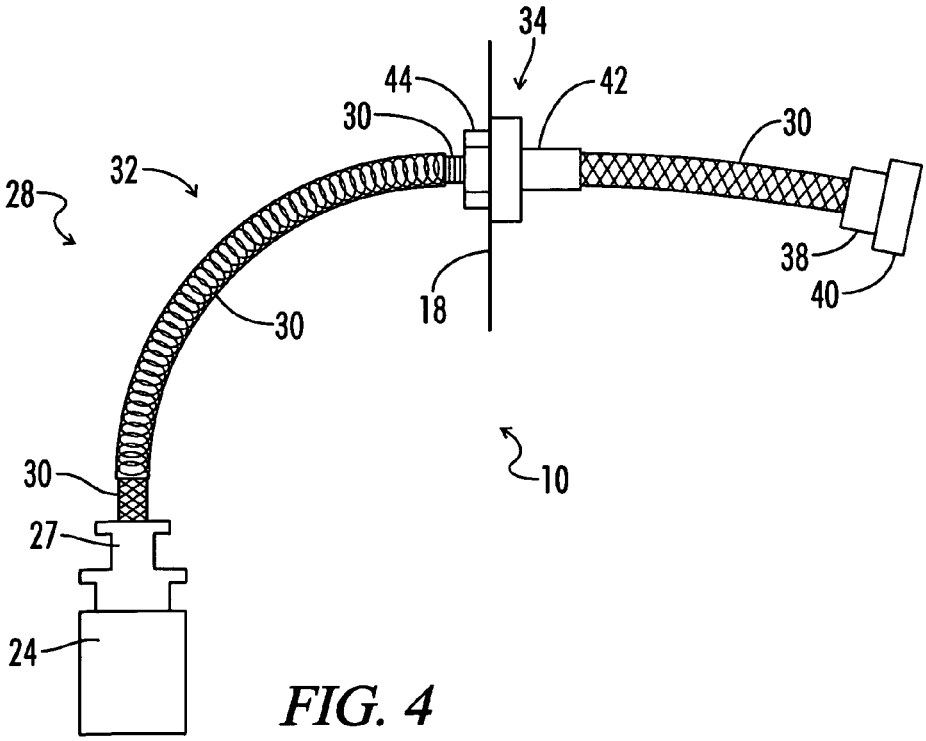
FIG. 4 is an illustrative view showing an embodiment of the system including a compression spring system.

Referring to FIG. 4, in another embodiment the spring assembly 32 includes a compression spring 56 which compresses to provide a biasing (e.g., first) longitudinal force upon the hose assembly 28. The compression spring 56 as shown may be arranged substantially along the length of a first section of the hose assembly 28 which resides within the interior of the boat regardless of the length to which the hose 30 is extended away from the boat hull and outside of the boat. The compression spring 56 may be arranged along at least a portion of the first section of the hose assembly 28 rather than the entire length which remains within the boat at the maximum extended length 53 of the hose outside of the boat, but will generally be arranged along a sufficient length of the hose assembly to provide a desired biasing effect. Or in other words, the compression of the spring assembly 32 is arranged along or otherwise within a first section of the hose assembly 28 which applies the biasing force with respect to a second section of the hose assembly 28 which may extend outside of the boat through the aperture 46 and seal 34.

In an embodiment the spring assembly 32 may include single or multiple springs having either a single diameter along their length or multiple diameter coils.

In various embodiments the hose assembly 28 may be configured such that the cap 36 may only be extended a maximum length 53 such as for example 36" from the boat hull or otherwise from the seal 34 of the hose assembly 28. This maximum length 53 may be determined and effected by additional components based upon a safety factor to prevent damage to the system 10 itself, or may be merely a maximum allowable extension based upon the ratings of the spring assembly 32 used.

Referring now generally to FIGS. 2-4, the seal 34 includes in various embodiments as shown a grommet 42 and a grommet nut 44 and is shaped to permit passage of the hose assembly 28 through the grommet 42 while simultaneously reducing or preventing water from entering the interior of the boat through the aperture 46 while the hose assembly 28 is in place. For this purpose the grommet 42 has a first diameter 43*a* which is greater than the diameter of the aperture 46 in the boat hull and a second diameter 43*b* which is less than the diameter of the aperture 46 in the boat hull and greater than the outer diameter of the hose 30. Various configurations of grommets 42 and grommet nuts 44 are well known in the art for such applications, and further description may be omitted here as unnecessary.

In various embodiments as shown the converter 26 is coupled to the pump assembly 24 as described above. The pump assembly 24 may include more specifically for example a ¾" conduit such as a pipe or hose to which the converter 26 is coupled. Alternatively, the converter 26 may be coupled to the pump directly, or may be coupled directly to for example a threaded aperture in the livewell where the pump is positioned inside of the livewell. The particular configuration is unnecessary to the scope of the present invention, and various forms of converters 27 may be provided to couple for example a hose 30 having a ⅝" outer diameter to whatever portion of the pump assembly 24 is available in a given application.

In various embodiments the cap 36 at the second end 37 of the hose assembly 28 may further include one or more of a stop cap 38 and a grip cap 40. The stop cap 38 may be configured with a diameter at least as great as the second diameter of the grommet 42, or in other words at least as great as the aperture 46 in the boat hull, such that the stop cap 38 and subsequently the hose assembly 28 is prevented from being pulled into the interior of the boat in response to the biasing force of the spring assembly 32. The grip cap 40, when provided, may be configured with a diameter greater than that of the stop cap 38 and positioned on the outside of the stop cap 38 with respect to the boat hull. In this manner a user may more conveniently grip the cap 36 and apply the second longitudinal force to (e.g., pull) the hose assembly 28.

Having described the structure of the livewell drainage system 10 of the present invention, operation of the system 10 may be further described.

Figure 5:
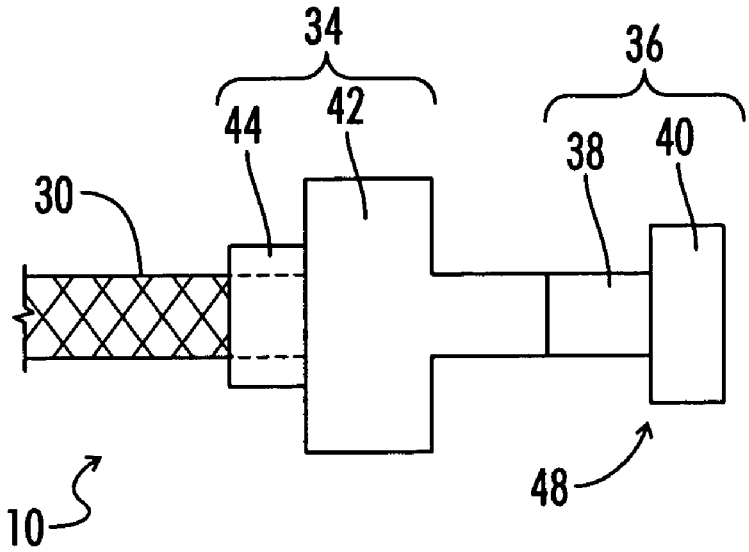
FIG. 5 is a broken view of an embodiment of the system in a retracted position.

In a first (e.g., standard) mode of operation for the system 10, the hose assembly 28 is not in use and the biasing force of the spring assembly 32 operates on the second end 37 of the hose assembly 28 and thereby urges the cap 36 against the grommet 42 and into a first position 48 as shown for example in FIG. 5. The biasing force of the spring assembly 32 may in various embodiments be small or negligible in the first position 48, but some tension or compression depending on the type of spring assembly 32 may generally be desirable to continuously urge the cap 36 against the grommet 42 and more generally against the boat hull so as to prevent the hose assembly 28 from vibrating or rattling in place.

Figure 6:
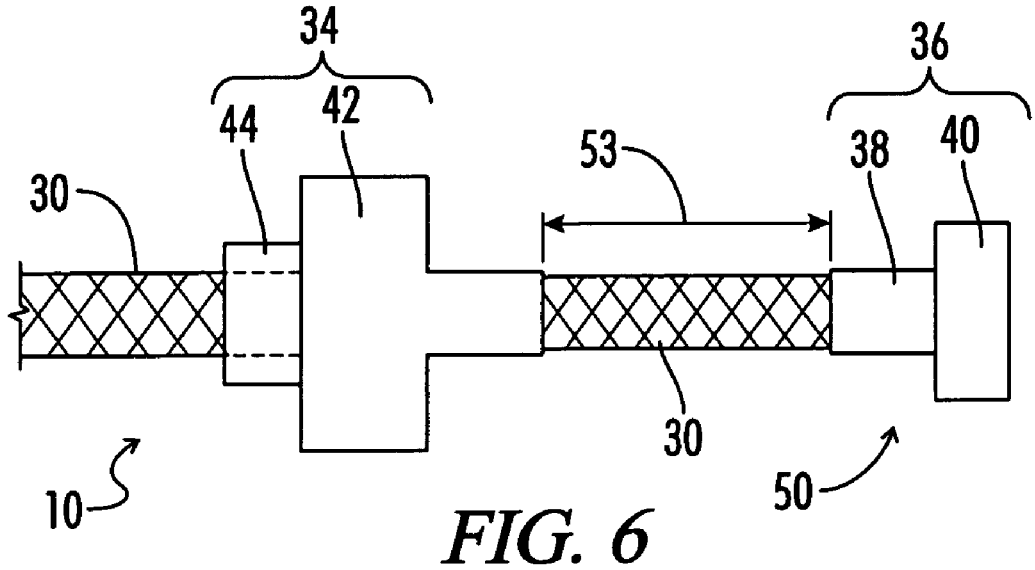
FIG. 6 is a broken view of an embodiment of the system in an extended position.

In a second (e.g., draining) mode of operation for the system 10, a user positioned either within the boat or outside of the boat may grasp the hose assembly 28 using for example the grip cap 40 where available and pull the hose 30 from the grommet 42 to a second position 50, as shown for example in FIG. 6, by applying a second longitudinal force along the length of the hose 30 which is greater than the first longitudinal force applied by the spring assembly 32 generally. The hose 30 may be pulled up to a maximum length 52 for the system 10 and directed to a portable device, such as for example a bag sized to receive the captured fish and an appropriate amount of fluid from the livewell 20. The pump 24 may then be enabled, and in various embodiments a multiway valve in the pump rotated or otherwise configured to direct water flow from the livewell through the hose 30 and into the bag.

Upon discharging the desired amount of fluid from the livewell 20, the user may disable the pump 24 or otherwise configure the valve to prevent water flow from the livewell 20 and through the hose 30. The hose 30 may then be released and the biasing longitudinal force applied by the spring assembly 32 used to retract the second end 37 of the hose assembly 28 against the grommet 42 or otherwise against the boat hull.

In certain embodiments the hose assembly 28 may further include a locking mechanism (not shown) which maintains the second end 37 of the hose assembly 28 in a second position 50 between the first position 48 and the maximum length 52 for the hose assembly 28 with respect to the first position 48. The locking mechanism may automatically be enabled when a pulling motion applied by a user has concluded, or may be manually applied by the user when a desired length of the second end 37 of the hose assembly 28 with respect to the boat hull has been achieved. The locking mechanism may then be disabled by the user when the desired amount of fluid has been discharged from the livewell, such as for example by applying a brief pulling motion to the hose assembly 28, which permits the biasing force of the spring assembly 32 to take effect and retract the hose assembly 28 to the first position 48 again.

The previous detailed description has been provided for the purposes of illustration and description. Thus, although there have been described particular embodiments of the present invention of a new and useful "Livewell Drainage System with Integrated Retractable Hose Assembly," it is not intended that such references be construed as limitations upon the scope of this invention except as set forth in the following claims.

What is claimed is:

1. A livewell drainage system comprising:

a retractable hose assembly coupled on a first end to a livewell tank residing within a boat and extending therefrom through an aperture in the boat to a second end outside the boat, the second end of the hose assembly further comprising an end cap having a diameter greater than an outer diameter of the boat aperture, and a grommet positioned to interface the hose assembly with the aperture, the grommet having an inner diameter sized to engage an outer diameter for the hose, wherein the second end of the hose assembly during normal operation is urged to a first position against the boat and adjacent the aperture, and wherein the second end of the hose assembly during a drainage operation is moveable from the first position to a second position away from the boat in response to a longitudinal force applied by a user with respect to the hose.

2. The system of claim 1, the hose assembly further comprising at least an outer hose member, and at least a portion of the hose assembly further comprising a spring, wherein the spring applies a longitudinal force with respect to the hose assembly and thereby urges the second end of the hose assembly to a first position against an exterior side of the boat and adjacent the aperture.

3. The system of claim 2, wherein the spring comprises a tension coil spring assembly.

4. The system of claim 2, wherein the spring comprises a compression coil spring biased along at least part of the hose.

5. The system of claim 2, wherein the spring comprises a polymer elastomer material.

6. The system of claim 2, the hose assembly coupled to the livewell via a pump assembly configured to direct fluid from within the livewell through the hose assembly to the exterior of the boat.

7. The system of claim 1, the end cap further comprising a stop cap having a first diameter greater than an inner diameter of the grommet, and a grip cap having a second diameter greater than the first diameter and positioned outside of the stop cap with respect to the hull.

8. A livewell drainage system for a fishing boat having an interior, an exterior, a hull, a livewell compartment residing within the interior of the boat, and a mechanical pump assembly coupled to the livewell, the system comprising:

a hose coupled on a first end to the pump assembly and extending from the livewell through an aperture in the hull such that a second end of the hose is outside of the hull;

a seal interfacing the hose and the hull in association with the aperture; and a cap positioned at the second end of the hose, the cap having a diameter greater than an outer diameter of the seal so as to prevent passage of the cap through the hull and further effective to apply an equal and opposite force in response to the first longitudinal force when the hose is in a compressed position, the cap further comprising a stop cap having a first diameter greater than the outer diameter of the seal so as to prevent passage of the cap through the hull and further effective to apply an equal and opposite force in response to the first longitudinal force when the hose is in the compressed position, and a grip cap having a second diameter greater than the first diameter and positioned outside the stop cap with respect to the boat hull, wherein the system is effective to deliver fluid pumped from an interior of the livewell compartment by the pump assembly to the exterior of the boat through the second end of the hose, and wherein the hose further comprises a spring arranged along at least a portion of its length and applying a first longitudinal force with respect to the second end of the hose, the hose effective to extract from the hull in response to a second longitudinal force applied to the hose and greater than the first force.

9. The system of claim 8, the seal further comprising a grommet and a grommet nut.

10. The system of claim 8, the hose arranged to extract no more than 36" from the hull in response to a second longitudinal force applied to the hose and greater than the first force.

11. The system of claim 8, the spring further comprising a compression spring.

12. The system of claim 8, the spring further comprising a polymer elastomer spring.

13. A livewell drainage system for a fishing boat having an interior, an exterior, a hull, a livewell compartment residing within the interior of the boat, and a mechanical pump assembly coupled to the livewell, the system comprising:

a hose coupled on a first end to the pump assembly and extending from the livewell through an aperture in the hull such that a second end of the hose is outside of the hull;

a seal interfacing the hose and the hull in association with the aperture, the seal further comprising a grommet and a grommet nut; and a cap positioned at the second end of the hose, the cap having a diameter greater than an outer diameter of the seal so as to prevent passage of the cap through the hull and further effective to apply an equal and opposite force in response to the first longitudinal force when the hose is in a compressed position, wherein the system is effective to deliver fluid pumped from an interior of the livewell compartment by the pump assembly to the exterior of the boat through the second end of the hose, and wherein the hose further comprises a spring arranged along at least a portion of its length and applying a first longitudinal force with respect to the second end of the hose, the hose effective to extract from the hull in response to a second longitudinal force applied to the hose and greater than the first force.

14. The system of claim 13, the hose arranged to extract no more than 36" from the hull in response to a second longitudinal force applied to the hose and greater than the first force.

15. The system of claim 13, the spring further comprising a compression spring.

16. The system of claim 13, the spring further comprising a polymer elastomer spring.

* * * * *